US005783349A

United States Patent [19]

Spiewak et al.

[11] Patent Number: 5,783,349

[45] Date of Patent: Jul. 21, 1998

[54] LIQUID DEVELOPER COMPOSITIONS

[75] Inventors: John W. Spiewak, Webster, N.Y.; Mary Ann Machonkin, Homosassa, Fla.; David H. Pan, Rochester, N.Y.; Scott D. Chamberlain, Macedon, N.Y.; Christopher M. Knapp, Fairport, N.Y.

[73] Assignee: Xerox Corporation, Stamford, Conn.

[21] Appl. No.: 886,064

[22] Filed: Jun. 30, 1997

[51] Int. Cl.[6] ..... G03G 9/135; H01B 1/06

[52] U.S. Cl. ..... 430/115; 252/1; 252/508

[58] Field of Search ..... 430/115; 252/1, 252/508

[56] References Cited

U.S. PATENT DOCUMENTS

| | | | |
|---|---|---|---|
| 4,614,699 | 9/1986 | Kitatani et al. | 430/115 |
| 4,707,429 | 11/1987 | Trout | 430/115 |
| 5,019,477 | 5/1991 | Felder | 430/115 |
| 5,028,508 | 7/1991 | Lane et al. | 430/115 |
| 5,030,535 | 7/1991 | Drappel et al. | 430/116 |
| 5,034,299 | 7/1991 | Houle et al. | 430/115 |
| 5,045,425 | 9/1991 | Swidler | 430/115 |
| 5,066,821 | 11/1991 | Houle et al. | 430/137 |
| 5,306,591 | 4/1994 | Larson et al. | 430/115 |
| 5,308,731 | 5/1994 | Larson et al. | 430/115 |
| 5,563,015 | 10/1996 | Bonsignore et al. | 430/106 |
| 5,714,297 | 2/1998 | Chamberlain et al. | 430/115 |

*Primary Examiner*—Roland Martin
*Attorney, Agent, or Firm*—E. O. Palazzo

[57] ABSTRACT

A liquid developer comprised of a nonpolar liquid, resin, optional colorant, a charge director, and an optional charge control agent, and wherein the charge director is comprised of a mixture of phosphoric acid esters I, II and III, and IV a nonpolar liquid soluble organic aluminum complex of the formulas

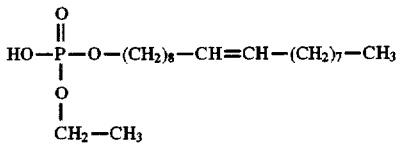

I

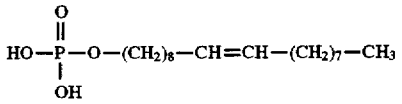

II

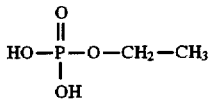

III

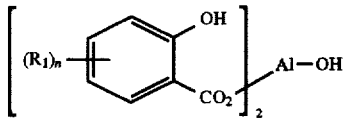

IV

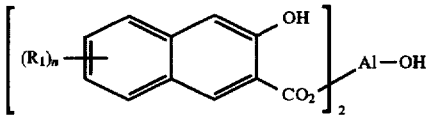

hydrates thereof or mixtures thereof, wherein $R_1$ is selected from the group consisting of hydrogen and alkyl, and n represents a number of from about 1 to about 6.

27 Claims, No Drawings

LIQUID DEVELOPER COMPOSITIONS

Illustrated in U.S. Ser. No. 778,990, now U.S. Pat. No. 5,688,624, the disclosure of which is totally incorporated herein by reference, are liquid developers with PEO:PPO block copolymer charge control agents, and a charge director, such as the aluminum salts of alkylated salicylic acid, like, for example, hydroxy bis[3,5-di-tertiary butyl salicylic] aluminate, or a mixture of the aluminum salts of alkylated salicylic acid, like, for example, hydroxy bis[3,5-di-tertiary butyl salicylic] aluminate and EMPHOS PS-900™, reference U.S. Pat. No. 5,563,015, the disclosure of which is totally incorporated herein by reference; U.S. Pat. No. 5,627,002, the disclosure of which is totally incorporated herein by reference, illustrates a liquid developer with certain cyclodextrins as charge control agents; in copending application U.S. Ser. No. 779,191, now U.S. Pat. No. 5,714,297, the disclosure of which is totally incorporated herein by reference, there are illustrated liquid developers with Rhodamine Y charge control agents; and in U.S. Ser. No. 778,855, now U.S. Pat. No. 5,672,456, the disclosure of which is totally incorporated herein by reference, there are illustrated liquid developers with a charge director of certain aluminum complexes. The appropriate components of these patents and pending applications may be selected as components for the developers of the present invention in embodiments thereof.

BACKGROUND OF THE INVENTION

This invention is generally directed to liquid developer compositions and the excellent developed images obtained thereof, especially in electrographic image on image printing processes wherein a stylus provides, or writes the image pattern on a dielectric receptor, and more specifically, the present invention relates to a liquid developer containing certain charge directors. The present invention specifically relates to positively charged liquid developers comprised of a nonpolar liquid, optionally but preferably a colorant, such as pigment, dye, or mixtures thereof, an optional charge control agent, such as poly(ethylene oxide-b-propylene oxide) block copolymer (PEO:PPO), and a charge director comprised of a mixture of (1) a phosphoric acid-ester mixture, and (2) the aluminum salts of alkylated salicylic acid like, for example, hydroxy bis[3,5-di-tertiary butyl salicylic] aluminate, reference U.S. Pat. No. 5,563,015, the disclosure of which is totally incorporated herein by reference, and which developers possess a number of advantages including the development and generation of images with improved image quality, especially with respect to four color, four pass ionographic development systems like the Xerox ColorgrafX 8900 printers, and wherein the developed images are of high quality and excellent resolution, and more specifically, wherein there are enabled high reflective optical densities (ROD) thereby permitting higher chroma images and thus maximizing the ROD for inks with for example, certain colorant amounts. The developers of the present invention in embodiments provide images with excellent, from about 1.3 to about 1.4, reflective optical density (ROD). Higher reflective optical densities provide images with deeper, richer desirable color or more extended chroma.

PRIOR ART

Developers which can discharge the electrostatic charge by exposing it to a modulated beam of radiant energy are known. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet. Insufficient particle charge can result in poor image quality and also can result in poor transfer of the liquid developer or solids thereof to paper or other final substrates. Poor transfer can, for example, result in poor solid area coverage if, for example, insufficient toner is transferred to the final substrate and can also cause image defects such as smears and hollowed fine features. Conversely, overcharging the toner particles can result in low reflective optical density images or poor color richness or chroma since only a few very highly charged particles can discharge all the charge on the dielectric receptor causing too little toner to be deposited. To overcome or minimize such problems, the liquid toners, or developers of the present invention were arrived at after substantial research, and which developers result in, for example, sufficient particle charge to enable effective transfer, but not so much charge as to yield images with lower optical densities and lower residual voltages because of excess toner charge. An advantage associated with the present invention includes controlling the increase of the desired positive charge on the developer particles.

A latent electrostatic image can be developed with toner particles dispersed in an insulating nonpolar liquid. These dispersed materials are known as liquid toners or liquid developers. A latent electrostatic image may be generated by providing a photoconductive imaging member or layer with a uniform electrostatic charge, and developing the image with a liquid developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 μm (microns) average by area size as measured with the Malvern 3600E particle sizer.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors illustrated may include both negative charge directors, such as lecithin, oil-soluble petroleum sulfonates and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) of vinyl toluene and styrene and (iv) butadiene and acrylate. As the copolymer with polyethylene and methacrylic acid or methacrylic acid alkyl esters, NUCREL® may be selected.

U.S. Pat. No. 5,030,535 discloses a liquid developer composition comprising a liquid vehicle, a charge control additive and toner pigmented particles.

Moreover, in U.S. Pat. No. 4,707,429, the disclosure of which is totally incorporated herein by reference, there are illustrated, for example, liquid developers with an aluminum stearate charge adjuvant. Liquid developers with certain charge directors are illustrated in U.S. Pat. No. 5,045,425. Also, stain elimination in consecutive colored liquid toners is illustrated in U.S. Pat. No. 5,069,995. Further, of interest with respect to liquid developers are U.S. Pat. Nos. 5,034,299; 5,066,821 and 5,028,508, the disclosures of which are totally incorporated herein by reference.

Illustrated in U.S. Pat. No. 5,306,591 is a liquid developer comprised of a liquid component, thermoplastic resin, an ionic or zwitterionic charge director, or directors soluble in a nonpolar liquid, and a charge additive, or charge adjuvant comprised of an imine bisquinone. In U.S. Statutory Invention Registration No. H1483 there is disclosed a liquid developer comprised of thermoplastic resin particles, and a charge director comprised of an ammonium AB diblock copolymer, and in U.S. Pat. No. 5,308,731 there is disclosed a liquid developer comprised of a liquid, thermoplastic resin particles, a nonpolar liquid soluble charge director, and a charge adjuvant comprised of a metal hydroxycarboxylic acid, the disclosures of each of these patents and statutory invention registration being totally incorporated herein by reference.

In U.S. Pat. No. 5,563,015, the disclosure of which is totally incorporated herein by reference, there is disclosed the aluminum salts of alkylated salicylic acid, like, for example, hydroxy bis[3,5-di-tertiary butyl salicylic] aluminate, or a mixture of the aluminum salts of alkylated salicylic acid, like, for example, hydroxy bis[3,5-di-tertiary butyl salicylic] aluminate and EMPHOS PS-900™.

SUMMARY OF THE INVENTION

Examples of objects of the present invention include:

It is an object of the present invention to provide a liquid developer with many of the advantages illustrated herein.

Another object of the present invention resides in the provision of a liquid developer capable of controlled or modulated particle charging for image quality optimization as indicated, for example, by maximizing the reflective optical density of said images.

It is a further object of the invention to provide a positively charged liquid developer wherein there are selected as charge directors certain mixtures.

It is still a further object of the invention to provide positively charged liquid developers wherein developed image defects, such as smearing, loss of resolution and loss of density, are eliminated or minimized.

Also, in another object of the present invention there are provided positively charged liquid developers with excellent reflective optical density (ROD) for developed images.

Furthermore, in another object of the present invention there are provided liquid developers that enable excellent image characteristics, and which developers enhance the positive charge of the resin, such as ELVAX®, based colored developers.

In embodiments, the present invention is directed to liquid developers comprised of a nonpolar liquid, optional colorant, such as pigment, dye, or mixtures thereof, resin, or polymer, preferably thermoplastic resin, an optional charge control agent, such as a PEO:PPO charge control agent, and a charge director, comprised of a mixture of (1) a mixture of unsaturated phosphoric acid esters, such as ethyl-oleyl phosphoric acid diester and oleyl phosphoric diacid ester and a saturated ethyl phosphoric diacid ester, and (2) the aluminum salts of alkylated salicylic acid, like, for example, hydroxy bis[3,5-di-tertiary butyl salicylic] aluminate, or (2) a mixture of (1) and the aluminum salts of alkylated salicylic acid, like, for example, hydroxy bis[3,5-di-tertiary butyl salicylic] aluminate and EMPHOS PS-900™, reference U.S. Pat. No. 5,563,015, the disclosure of which is totally incorporated herein by reference.

More specifically, the present invention relates to a positively charged liquid developer comprised of a nonpolar liquid, thermoplastic resin particles, an optional triblock copolymer charge control agent, an optional charge adjuvant, optional colorant, especially pigment, and a charge director comprised of a mixture of I phosphoric acid esters, available as X-8057 from Petrolite Chemicals, and II a nonpolar liquid soluble organic aluminum complex, hydrates thereof, or mixtures thereof of the Formulas illustrated herein

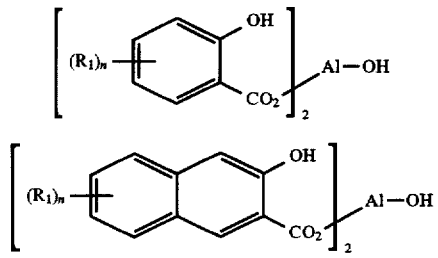

IV wherein $R_1$ is selected from the group consisting of hydrogen and alkyl, and n represents a number, such as from about 1 to about 6.

Of importance with respect to the present invention is the selection of the charge director mixture which can for example, be added to the liquid developer mixture after its formation. Up to three phosphorus containing components comprise the phosphoric acid ester mixture available from and sold by Petrolite Corporation. The chemical formulas for these three phosphorus components are, for example, as follows, wherein in Formula I there is, for example, preferably present at least about or about 80 mole percent, greater than about 80 mole percent, and more specifically, for example, from about 85 to about 95 mole percent, and, for example, preferably less than about, or about 20 mole percent, and more specifically, from about 5 to about 15 mole percent of Components II and III, and in embodiments Component III may not be present, that is about zero percent of this component is present.

X-8057 Component I:

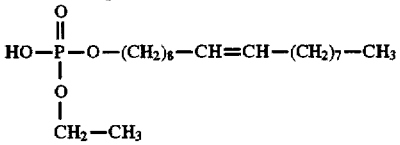

>80.00 mole % - Ethyl-Oleyl Phosphoric Monoacid Diester
or >84.56 weight %

X-8057 Component II:

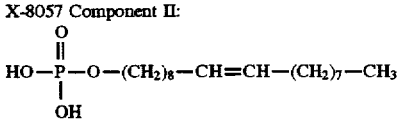

Oleyl Phosphoric Diacid Monoester

X-8057 Component III:

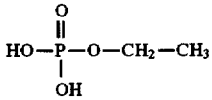

Ethyl Phosphoric Diacid Monoester
<20.00 mole % for Components II and III
or <15.44 weight %

The 80 mole percent, or more specifically, the greater than 80 mole percent corresponds to greater than 84.56 weight percent; and the less than about 20 mole percent corresponds to less than 15.44 weight percent. The molecular weights are, for example, 376.522 grams/mole for I, 348.468 for II, and 126.052 grams/mole for III.

To convert from mole percent to weight percent, assume that the total number of moles for all three Components I, II, and III is 1.00; that 85 mole percent of I is present, 67 mole percent of 15 mole percent for Component II, and 33 mole percent of 15 mole percent for Component III, reference claim 5, for example; thus, for I 0.8500 mole multiplied by 376.522 grams/mole is equal to 320.044 grams; for II 15 mole multiplied by 0.67 is equal to 10.05 mole percent, therefore, 0.1005 mole multiplied by 348.468 grams/mole is equal to 35.021 grams; and for III 5.00 multiplied by 33 is equal to 4.95 mole percent, therefore, 0.0495 mole multiplied by 126.052 grams/mole is equal to 6.240 grams. The weight percent is arrived at by adding the total of the three components, that is 320.44 grams, plus 35.021 grams, plus 6.240 grams is equal to 361.305 grams divided into the weight of one component. More specifically, the weight percent for Component I is 320.044 divided by 361.305 multiplied by 100 and is equal to 88.58 percent. Similar calculations for II and III indicate, in this instance, 9.69 weight percent for II, and 1.73 weight percent for III.

Charge director examples are as indicated herein and wherein the director mixture contains, for example, from about 80.1 mole percent to about 99.9 mole percent of the unsaturated ethyl-oleyl phosphoric acid diester I, and from about 0.1 mole percent to about 19.9 mole percent of a mixture of the saturated ethyl phosphoric diacid monoester and the unsaturated oleyl phosphoric diacid monoester wherein the latter is dominant if not the exclusive component in embodiments, and wherein the aforementioned Components I, II, and III comprise about 10 to 90 weight percent of the charge director composition, and IV, the nonpolar soluble organic aluminum complex, or aluminum containing charge director component, such as hydroxy bis[3,5-di-tertiary butyl salicylic] aluminate monohydrate, also known in the abbreviated form as Alohas, comprises from about 90 to about 10 weight percent of the mixture of charge directors. Preferred ranges for the charge director mixture is from about 30 to about 70 weight percent of the two or three phosphorus containing charge director Components I, II, and III, and from about 70 to about 30 weight percent of the soluble organic aluminum complex charge director component, and even more preferably, the amount ranges are from about 40 to about 60 for I, II, and III, and from about 60 to about 40 weight percent of IV.

X-8057 phosphoric acid ester composition is believed to be mainly, for example, equal to or greater than about 80 mole percent of the unsaturated alkyl ester Component I. In contrast, EMPHOS PS-900 phosphoric acid ester component is entirely composed of a saturated branched alkyl ester component, the isotridecyl group. As alkyl chains increase beyond 12 carbons in length, molecules containing such longer alkyl chains have a tendency to crystallize thereby rendering them insoluble in the aliphatic hydrocarbon mixtures selected as liquid carriers. Since liquid developer insoluble materials cannot be as effectively used as charge director components, crystallization and insolubility are avoided, or minimized in embodiments by introducing branching and/or unsaturation in the long alkyl groups of the phosphoric acid ester charge director components thereby rendering them more suitable for certain imaging systems as charge directors. The X-8057 has present unsaturation to prevent or minimze crystallization and aliphatic hydrocarbon insolubility.

Other unsaturated C18 phosphoric acid ester groups that may be selected as the dominant ester Component I (at least about 80 mole percent) in the phosphoric acid esters of the charge director composition include linoleyl, linolenyl, vaccenicyl, and elaidcyl also known as 9,12-octadecadienyl; 9,12,15-octadecatrienyl; trans-11-octadecenyl; and trans-9-octadecenyl, respectively.

When selected various optional charge control agents can be utilized, such as poly(ethylene oxide-b-propylene oxide-b-ethylene oxide) triblock copolymers of the formula $(CH_2—CH_2—O)_x—(CH_2—CHCH_3—O)_y—(CH_2—CH_2—O)_x$ wherein x and y represent the average number of ethylene oxide and propylene oxide repeat units in each of their respective blocks or segments. Effective amounts of charge control agents are selected, for example from about 0.1 to about 10 weight percent of the solids.

Also, there may be selected, when present, optional charge control agents of cyclodextrin, illustrated in U.S. Patent No. 5,627,002, the disclosure of which is totally incorporated herein by reference.

Examples of nonpolar liquid carriers or components selected for the developers of the present invention include a liquid with an effective viscosity of, for example, from about 0.5 to about 500 centipoise, and preferably from about 1 to about 20 centipoise, and a resistivity equal to or greater than $5\times10^9$ ohm/cm, such as $5\times10^{13}$. Preferably, the liquid selected is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C.. ISOPAR L® has a mid-boiling point of approximately 194° C.. ISOPAR M® has an auto ignition temperature of 338° C.. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of $10^9$ ohm-centimeters and a dielectric constant below 3.0 in embodiments of the present invention. Moreover, the vapor pressure at 25° C. should be less than 10 Torr in embodiments.

While the ISOPAR® series liquids can be the preferred nonpolar liquids for use as dispersant in the liquid developers of the present invention, the essential characteristics of viscosity and resistivity may be satisfied with other suitable liquids. Specifically, the NORPAR® series available from Exxon Corporation, the SOLTROL® series available from the Phillips Petroleum Company, and the SHELLSOL® series available from the Shell Oil Company can be selected. Moreover, other liquids not specifically mentioned may also be selected, it is believed, in embodiments of the present invention.

The amount of the liquid employed in the developer of the present invention can vary, and is, for example, from about 85 to about 99.9 percent, and preferably from about 90 to about 99 percent by weight of the total developer dispersion, however, other effective amounts may be selected. The total solids, which include resin, colorant, like pigment and charge control additive content of the developer in embodiments is, for example, from about 0.1 to about 15 percent by weight, preferably from about 0.3 to 10 percent, and more preferably, from about 0.5 to about 10 percent by weight.

Typical suitable binders, especially thermoplastic resins, can be selected for the liquid developers of the present invention in effective amounts, for example, in the range of from about 99.9 percent to about 40 percent, and preferably from about 80 percent to about 50 percent of developer solids comprised of thermoplastic resin, pigment and charge control agent, and in embodiments other components that may comprise the toner. Generally, developer solids include the thermoplastic resin colorant, such as pigment and charge control agent. Examples of resins include polyesters, especially the SPAR polyesters, commercially available, and see for example U.S. Pat. No. 3,590,000, the disclosure of which is totally incorporated herein by reference; reactive extruded polyesters, with a gel amount of from about 10 to about 40 percent, and other gel amounts, or substantially no gel, reference U.S. Pat. No. 5,376,494, the disclosure of which is totally incorporated herein by reference; ethylene vinyl acetate (EVA) copolymers (ELVAX® resins, E.I. DuPont de Nemours and Company, Wilmington, Del.); copolymers of ethylene and an alpha, beta-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E. I. DuPont de Nemours and Company); or blends thereof.

The liquid developers of the present invention may optionally contain, and preferably does contain in embodiments a colorant dispersed in the resin particles. Colorants, such as pigments or dyes and mixtures thereof, are preferably present to render the latent image visible. Colorants include pigments, dyes, mixtures thereof, mixtures of dyes, mixtures of pigments, and the like.

The colorant, preferably pigment, may be present in the toner in an effective amount of, for example, from about 0.1 to about 60 percent, and preferably from about 10 to about 50, and in embodiments about 40 percent by weight based on the total weight of solids contained in the developer. The amount of colorant used may vary depending on the use of the developer. Examples of colorants which may be selected include carbon blacks available from, for example, Cabot Corporation, FANAL PINK™, PV FAST BLUE™, the colorants as illustrated in U.S. Pat. No. 5,223,368, the disclosure of which is totally incorporated herein by reference; cyan, magenta, yellow, and the like colorants; other known colorants, especially pigments; and the like. Without colorant, the composition may be selected for photoresists, and the like.

The charge director mixture of I, II, III, and IV is present in various effective amounts of, for example, from about 0.001 to about 5, and preferably from about 0.005 to about 1 weight percent or parts, and include as one component of the mixture IV, aluminum di-tertiary-butyl salicylate; hydroxy bis[3,5-di-tertiary butyl salicylic] aluminate; hydroxy bis[3,5-di-tertiary butyl salicyic] aluminate mono-, di-, tri- or tetrahydrates; hydroxy bis[salicylic] aluminate; hydroxy bis[monoalkyl salicylic] aluminate; hydroxy bis [dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis [dialkylated hydroxy naphthoic acid] aluminate, wherein alkyl preferably contains 1 to about 6 carbon atoms; bis [trialkylated hydroxy naphthoic acid] aluminate wherein alkyl preferably contains 1 to about 6 carbon atoms; or bis[tetraalkylated hydroxy naphthoic acid] aluminate wherein alkyl preferably contains 1 to about 6 carbon atoms; and the like.

To further increase the toner particle charge and, accordingly, increase the mobility and transfer latitude of the toner particles, charge adjuvants can be added to the toner particles. For example, adjuvants, such as metallic soaps like aluminum or magnesium stearate or octoate, fine particle size oxides, such as oxides of silica, alumina, titania, and the like, paratoluene sulfonic acid, and polyphosphoric acid, may be added. These types of adjuvants can assist in enabling improved toner charging characteristics, namely, an increase in particle charge that results in improved electrophoretic mobility for improved image development and transfer to allow superior image quality with improved solid area coverage and resolution in embodiments. The adjuvants can be added to the toner particles in an amount of from about 0.1 percent to about 15 percent of the total developer solids, and preferably from about 3 percent to about 7 percent of the total weight percent of solids contained in the developer.

The liquid electrostatic developer of the present invention can be prepared by a variety of processes such as, for example, mixing in a nonpolar liquid the thermoplastic resin, optional charge control agent, and colorant in a manner that the resulting mixture contains, for example, about 30 to about 60 percent by weight of solids; heating the mixture to a temperature of from about 40° C. to about 110° C. until a uniform dispersion is formed; adding an additional amount of nonpolar liquid sufficient to decrease the total solids concentration of the developer to about 10 to about 30 percent by weight; cooling the dispersion to about 10° C. to about 30° C.; adding the X-8057 phosphoric acid ester mixture I, II, and III, and the aluminum complex IV, charge director composition to the dispersion; and diluting the dispersion.

In the initial mixture, the resin, colorant and charge control agent may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like a spherical cylinder of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 30 to about 60 percent solids. This mixture is then subjected to elevated temperatures during the initial mixing procedure to plasticize and soften the resin. The mixture is sufficiently heated to provide a uniform dispersion of all the solid materials of, for example, colorant, charge director, charge control, and resin. However, the temperature at which this step is undertaken should not be so high as to degrade the nonpolar liquid or decompose the resin or colorant if present. Accordingly, the mixture in embodiments is heated to a temperature of from about 50° C. to about 110° C., and preferably from about 50° C. to about 80° C.. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added should be sufficient in embodiments to decrease the total solids concentration of the dispersion to about 10 to about 30 percent by weight.

The dispersion is then cooled to about 10° C. to about 30° C., and preferably to about 15° C. to about 25° C., while mixing is continued until the resin admixture solidifies or hardens. Upon cooling, the resin admixture precipitates out of the dispersant liquid. Cooling is accomplished by methods such as the use of a cooling fluid like water, glycols such as ethylene glycol, in a jacket surrounding the mixing vessel. Cooling is accomplished, for example, in the same vessel, such as an attritor, while simultaneously grinding with particulate media to prevent the formation of a gel or solid mass, without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 4 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778; 4,783,389, the disclosures of which are totally incorporated herein by reference. Thereafter, there is added to the developer formed the charge director mixture as an about 3 or an about 6 weight percent solution dissolved in the developer carrier fluid. After ambient storage for an effective time, for example at least about 6 to about 7 days, the liquid developer is fully charged and can be selected to develop electrostatic latent images.

As illustrated herein, the developers or inks of the present invention can be selected for imaging and printing methods wherein, for example, a latent image is formed on a photoconductive imaging member, reference for example selenium, selenium alloys, those of U.S. Pat. No. 4,265,990, the disclosure of which is totally incorporated herein by reference, and the like; followed by development with the liquid developer, by, for example, immersion of the imaging member in the liquid toner; transfer to a suitable substrate like paper; and fixing by heating. The developers of the present invention are especially useful in the Xerox Corporation ColorgrafX Systems 8900 series printers, especially the 8936.

Disclosed is a positively charged liquid developer wherein the liquid has a viscosity of from about 0.5 to about 20 centipoise and resistivity equal to or greater than about $5\times10^9$, and the resin has a volume average particle diameter of from about 0.1 to about 30 microns; a developer wherein the resin is a copolymer of ethylene and vinyl acetate; a developer wherein the colorant, especially pigment, is present in an amount of from about 0.1 to about 60 percent by weight based on the total weight of the developer solids; a developer wherein the colorant is carbon black, cyan, magenta, yellow or mixtures thereof, and more specifically, wherein the colorant is a cyan pigment; a developer wherein the charge control agent is present in an amount of from about 0.05 to about 10 weight percent based on the weight of the developer solids of resin, and colorant, such as pigment; a developer wherein the liquid for the developer is an aliphatic hydrocarbon; a developer wherein the aliphatic hydrocarbon is a mixture of branched hydrocarbons of from about 8 to about 16 carbon atoms, or a mixture of normal hydrocarbons of from about 8 to about 16 carbon atoms; a developer wherein the aliphatic hydrocarbon is a mixture of branched hydrocarbons of from about 8 to about 16 carbon atoms; a developer wherein the resin is an alkylene polymer, a styrene polymer, an acrylate polymer, a polyester, or mixtures thereof; an imaging method which comprises forming an electrostatic latent image followed by the development thereof with the liquid developer illustrated herein; an ionographic imaging method which comprises charging a receptor followed by the development thereof with the developer illustrated herein; a developer wherein the charge director is comprised of a mixture of (1) a nonpolar liquid soluble organic aluminum complex combined, and (2) X-8057 a phosphoric acid ester mixture; and a developer wherein the charge director is comprised of a mixture of (a) I, II, and III, and (b) IV; a positively charged liquid developer comprised of a nonpolar liquid, thermoplastic resin particles, colorant such as pigment, the charge director mixture, and a charge control agent comprised of cyclodextrin, or poly(ethylene oxide-b-propylene-oxide-b-ethylene oxide) copolymer.

Embodiments of the invention will be illustrated in the following nonlimiting Examples. The toner particle size can range from about 0.1 to about 3.0 micrometers and the preferred particle size range is about 0.5 to about 1.5 micrometers. Particle size was measured by a Horiba CAPA-500 centrifugal automatic particle analyzer manufactured by Horiba Instruments, Inc., Irvine, Calif. The total developer charge (Q in microcoulombs) was measured using the series-capacitor technique. The charge in all samples was measured at 400 volts for 0.05 second.

The electrical properties of liquid developers can be reviewed using a series-capacitor method, which is a well-established method for determining the dielectric relaxation time in partially conductive materials as, for example, might be found in "leaky" capacitors, reference U.S. Pat. No. 5,459,077, the disclosure of which is totally incorporated herein by reference.

Two series capacitors can be used. One is comprised of a dielectric layer (MYLAR®) which corresponds to the photoreceptor, and the other is comprised of a layer of liquid (ink). Although a constant bias voltage is maintained across the two capacitors, the voltage across the ink layer decays as the charged particles within it move. Measurement of the external currents allows the observation of the decay of voltage across the ink layer. Depending on the composition of the ink layer, this reflects the motion of charged species in real time.

Application of a codeveloped theoretical analysis, together with a knowledge of the dielectric thicknesses of the MYLAR® and ink layers, the applied bias voltage and the observed current, enables the measurement of the total collected charge (Q).

CONTROL 1

Cyan Liquid Toner Concentrate and Developer:

Control 1A: Cyan Liquid Toner Concentrate (27803-7 as prepared in 27803-46 that follows): 50 percent PV FAST BLUE™ Pigment and 50 percent (by weight throughout) ELVAX 200W™ Resin and no CCA (charge control additive, charge control agent or adjuvant).

Control 1B: Cyan Liquid Developer (27846-16-2): 4 percent Toner Solids and 50/1 Hydroxy bis[3,5-di-tertiary Butyl Salicylic] Aluminate Monohydrate: EMPHOS PS-900™ (1:1 by weight) Charge Director.

Control 1A: (27803-46) Cyan Toner (Developer) Concentrate:

One hundred and thirty five (135.0) grams of ELVAX 200W™ (a copolymer of ethylene and vinyl acetate with a melt index at 190° C. of 2,500, available from E. I. DuPont de Nemours & Company, Wilmington, Del.), 135.0 grams of the cyan pigment PV FAST BLUE™ (Hoechst-Celanese), and 405 grams of ISOPAR L® (Exxon Corporation) were added to a Union Process 1S attritor (Union Process Company, Akron, Ohio) charged with 0.1857 inch (4.76 millimeters) diameter carbon steel balls. The resulting mixture was milled in the attritor for 2 hours at 150 rpm while heating the attritor contents at from about 70° to about 75° C. (Centigrade throughout) by passing steam through the attritor jacket. After the conclusion of the 2 hour attritor hot stage, 675 grams of ISOPAR G® were added to the attritor and cold tap water was passed through the attritor jacket, which cooled the attritor contents to about 23° C.. The stirring speed of the attritor was maintained at 250 rpm for this 2 hour cold grind period. The dispersion in the attritor was separated from the steel balls by passing the attritor contents through a metal grate and further rinsing the steel balls with about 300 grams of ISOPAR G® to collect residual liquid toner concentrate adhering to the steel balls. This batch of cyan control concentrate had a developer solids concentration of 14.674 weight percent.

Control 2A: (27803-7) Cyan Toner Concentrate:

Four batches of cyan liquid toner concentrate were prepared as described above and were combined to provide the Control 1 A cyan liquid toner concentrate. Cyan Control developer concentrate 1A contained 15.691 percent solids and was used to formulate the control cyan liquid developer. Control 1 B was charged with 50/1 hydroxy bis[3,5-di-tertiary butyl salicylic] aluminate monohydrate: EMPHOS PS-$_{900}$™ charge director mixture.

Control 1 B: (27846-16-2) Cyan Liquid Developer:

To 713.79 grams of the above cyan control toner concentrate 2A (15.691 percent solids) were added 1,899.54 grams of ISOPAR G® (Exxon Corporation) and 186.67 grams of the Example IB control charge director solution (3 percent solids), hydroxy bis[3,5-di-tertiary butyl salicylic] aluminate monohydrate:EMPHOS PS-900™ (1:1 by weight) in ISOPAR G®, to provide a charge director level of 50.0 milligrams per gram toner solids in the Control 1B cyan liquid developer. The Control 1B cyan liquid developer was formulated to provide 4.0 weight percent toner solids [(713.79 grams) (0.15691)=112.00 grams toner solids in 2,800 grams of liquid developer weight] wherein the toner solids include toner resin and pigment. Print testing of the cyan Control 1B liquid developer was accomplished 17 days after charging (the time at which the charge director was added) which was well after equilibrium charging was attained. The print tests were obtained on a Xerox ColorgrafX 8954 wide format printer and the results are provided in Table 1 of Example II.

EXAMPLE I

Hydroxy Bis[3,5-di-tertiary Butyl Salicylic] Aluminate Monohydrate Charge Directors: Hydroxy Bis[[3,5-di-tertiarv Butyl Salicylic] Aluminate Monohydrate Synthesis and Charge Director Solution Formulations Therefrom:

Charge Director Synthesis I: Synthesis of Hydroxy Bis[3, 5-di-tertiary Butyl Salicylic] Aluminate Monohydrate at Elevated Temperature:

To a solution of 12 grams (0.3 mole) of NaOH in 500 milliliters of water were added 50 grams (0.2 mole) of 3,5-di-tert-butyl salicylic acid. The resulting mixture was heated to 60° C. to dissolve the acid. A second solution was prepared by dissolving 33.37 grams (0.05 mole) of aluminum sulfate, $Al_2(SO_4)_3.18H_2O$ into 200 milliliters of water with heating to 60° C.. The former solution containing the sodium salicylate salt was added at a rapid dropwise rate into the latter aluminum sulfate salt solution with stirring. When the addition was complete, the reaction mixture was stirred for an additional 5 to 10 minutes at 60° C. and then cooled to room temperature, about 25° C. The mixture was then filtered and the collected solid hydroxy bis(3,5-tertiary butyl salicylic) aluminate monohydrate was washed with water until the acidity of the used wash water was about 5.5. The product was dried for 16 hours in a vacuum oven at 110° C. to afford 52 grams (0.096 mole, 96 percent of theory) of a white powder of the above monohydrate, melting point of>300° C.. When a sample, about 50 grams, of the hydroxy bis(3,5-di-tertiary butyl salicylic) aluminate monohydrate was analyzed for water of hydration by Karl-Fischer titration after drying for an additional 24 hours at 100° C. in a vacuum oven, the sample contained 2.1 weight percent water. The theoretical value calculated for the monohydrate is 3.2 weight percent water.

Infrared spectra of the above product, hydroxy bis(3,5-di-tertiary butyl salicylic) aluminate monohydrate indicated the absence of peaks characteristic of the starting material di-tert-butyl salicylic acid, and indicated the presence of an Al-OH band at 3,660 $cm^{-1}$ and peaks characteristic of water of hydration. NMR analysis for the hydroxy aluminate complex was obtained for carbon, hydrogen, and aluminum nuclei and the spectra were all consistent with the above prepared hydroxy monohydrate.

Elemental Analysis Calculated for $C_{30}H_{41}O_7Al$: C, 66.25; H, 7.62; Al, 5.52. Elemental Analysis Calculated for $C_{30}H_{41}O_7Al.\ 1H_2O$: C, 64.13; H, 7.74; Al, 4.81.Elemental Analysis Found: C, 64.26; H, 8.1 1; Al, 4.67.

Charge Director Synthesis II: Synthesis of Hydroxy Bis[3, 5-di-tertiary Butyl Salicylic] Aluminate Monohydrate at Room Temperature:

The above procedure of charge director Synthesis I was repeated with the exception that the mixing of the two solutions and subsequent stirring was accomplished at room temperature, about 25° C. The product was isolated and dried as in charge director Synthesis I, and was identified as the above hydroxy aluminum complex hydrate by IR.

Formulation of Charge Director Solutions Based on Hydroxy Bis[3,5-di-tertiary butyl salicylic] Aluminate Monohydrate:

EXAMPLE IA

Charge Director Solution Based on Hydroxy Bis[3,5-di-tertiary Butyl Salicylic] Aluminate Monohydrate and EMPHOS PS-900 (1:1 by weight) in ISOPAR G® (27632-75-1).

An overall three (3) percent solution of hydroxy bis[3,5-di-tertiary butyl salicylic] aluminate monohydrate (from the above room temperature charge director Synthesis II procedure) and EMPHOS PS-900™ (Witco Chemical) was prepared in ISOPAR G® at room temperature by adding 2,716 grams of ISOPAR G® to 84.00 grams of hydroxy bis[3,5-di-tertiary butyl salicylic] aluminate monohydrate powder in a 3 gallon Nalgene high density polyethylene carboy. Immediately thereafter, 84.00 grams of pre-weighed EMPHOS PS-900™ were added to the carboy followed by another 2,716 grams of ISOPAR G®. The contents of the carboy were manually shaken and this charge director solution was stored for about 8 weeks at ambient conditions before using to charge the cyan developer described in Control 1 B.

EXAMPLE IB

Charge Director Solution Based on Hydroxy Bis[3,5-di-tertiary Butyl Salicylic] Aluminate Monohydrate and X-8057 (1:1 by weight) in ISOPAR G® (27846-9).

An overall six (6) percent solution of hydroxy bis[3,5-di-tertiary butyl salicylic] aluminate monohydrate (from the above room temperature charge director Synthesis II procedure) and X-8057 (Petrolite Corporation) was prepared in ISOPAR G® at room temperature by first preparing an X-8057-ISOPAR G® solution comprising 10.00 grams of X-8057 of Formula I indicated herein, and with components I, II, and III, dissolved in 313.30 grams of ISOPAR G®. The resulting X-8057-ISOPAR G® solution was then added to 10.00 grams of Alohas powder in a 500 milliliter Nalgene high density polyethylene bottle. Magnetic stirring of this charge director solution at ambient temperature, about 25° to about 35° C., was maintained for 1 week before using it to charge the cyan developer described in Example IIB.

EXAMPLE II

Cyan Liquid Toner Concentrate and Developer:

Example IIA: Cyan Liquid Toner Concentrate (27803-7): 50 percent PV FAST BLUE™ Pigment and 50 percent ELVAX 200W™ Resin and No CCA Example IIB: Cyan Liquid Developer (27846-16-1): 4 percent Toner Solids and 50/1 Hydroxy Bis[3,5-di-tertiary Butyl Salicylic] Aluminate Monohydrate:X-8057 (1:1 by weight) Charge Director

EXAMPLE IIA (27803-7) Cyan Toner Concentrate:

The same cyan developer concentrate prepared in Control 1A was used in Example IIA. Cyan Example IIA developer concentrate contained 15.691 percent toner solids and was used to formulate the experimental cyan liquid developer, Example IIB, charged with 50/1 hydroxy bis[3,5-di-tertiary butyl salicylic] aluminate monohydrate: X-8057 charge director.

EXAMPLE IIB (27846-16-1) Cyan Liquid Developer:

To 713.79 grams of the above cyan Example IIA toner concentrate (15.691 percent solids) were added 1,992.88 grams of ISOPAR G® (Exxon Corporation) and 93.33 grams of the Example IB charge director solution, (6 percent solids) hydroxy bis[3,5-di-tertiary butyl salicylic] aluminate monohydrate:X-8057 (1:1 by weight) in ISOPAR G®, to provide a charge director level of 50.0 milligrams per gram toner solids in this Example IIB cyan liquid developer. The Example IIB cyan liquid developer was formulated to provide 4.0 weight percent toner solids [(713.79 grams) (0.15691)=112.00 grams toner solids in 2,800 grams liquid developer weight] wherein the toner solids include toner resin and pigment.

The print test results were obtained on a Xerox Corporation ColorgrafX 8954 wide format printer for both the experimental cyan (Example IIB) liquid developer and the control cyan (Control 1 B) liquid developer, and the reflective optical density data (RODs), as measured with a Macbeth RD918 Reflectance Densitometer, are provided in Table 1. The printer was set at a contrast of 35 to 40 percent (providing an input voltage in the range of about 120 to 125 volts) and a process (Rexham 6262 paper speed) speed of 2 or 4 ips. The charge director component, hydroxy bis[3,5-di-tertiary butyl salicylic] aluminate monohydrate, is abbreviated in Table 1 as Alohas. Print testing of the cyan Example IIB liquid developer was accomplished 18 days after charging (the time at which the charge director was added) which was well after equilibrium charging was attained. Equilibrium charging levels for these liquid developers occurred after about 4 to 8 days standing at room temperature (22° to 230° C.). Equilibrium charging means that the Table 1 reflective optical densities (RODs) remained constant within experimental error (+ or −0.02 optical density units) for additional printings at the same conditions after the 4 to 8 day printing.

TABLE 1

Reflective Optical Density Data for the Control and Experimental Cyan Liquid Developers Wherein All Developers Contained 50 Percent PV FAST BLUE ™ Pigment and 4 Percent Toner Solids

| Liquid Developer I.D. | Charge Director Type and Preparative Source | Charge Director (CD) Level in mg CD/g Toner Solids | Reflective Optical Density (ROD) | Process Speed Inches/ Sec. (ips) |
|---|---|---|---|---|
| Control 1B | Alohas: Emphos PS-900 Example IA | 50/1 | 1.21 | 2 |
| | | | 1.20 | 4 |
| Example IIB | Alohas: X-8057 Example IB | 50/1 | 1.38 | 2 |
| | | | 1.36 | 4 |

Review of Table 1 indicates that at process speeds of both 2 and 4 inches per second (ips), the cyan liquid developer, Example IIB, [containing 50/1 Alohas:X-8057 (1:1 by weight) charge director] charged to higher levels than the control cyan liquid developer, Control 1B, containing the same amount of the control charge director, Alohas:EMPHOS PS-900™ (1:1 by weight). Thus, the presence of the mixture of the X-8057 phosphoric acid ester components and the Alohas charge director composition enabled higher toner charging in the experimental cyan liquid developer since the liquid developer formulation and printing parameters were otherwise the same. This higher charging level enabled the development of cyan images having higher reflective optical densities when printed on a Xerox Corporation ColorgrafX 8954 wide format printer. The higher density images possess more chroma as determined by visual observation.

Other embodiments and modifications of the present invention may occur to those of ordinary skill in the art subsequent to a review of the information presented herein; these embodiment, modifications, and equivalents thereof, are also included within the scope of this invention.

What is claimed is:

1. A liquid developer comprised of a nonpolar liquid, resin, optional colorant, a charge director, and an optional charge control agent, and wherein the charge director is comprised of a mixture of phosphoric acid esters I, II and III, and IV a nonpolar liquid soluble organic aluminum complex of the formulas

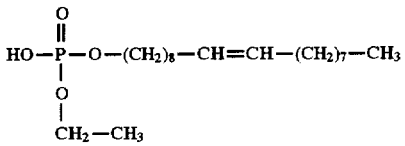

I

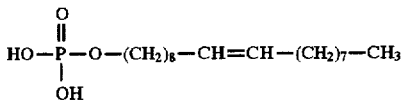

II

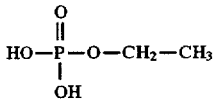

III

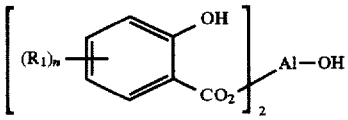

IV

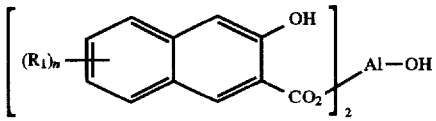

hydrates thereof or mixtures thereof, wherein $R_1$ is selected from the group consisting of hydrogen and alkyl, and n represents a number of from about 1 to about 6.

2. A developer in accordance with claim 1 wherein said mixture contains from about 1 to about 99 parts of I, II, and III, and from about 99 to about 1 parts of IV, and the colorant is present; and wherein I is present in an amount of about 80 mole percent, and II and III are each present in an amount of about 20 mole percent, and said developer is positively charged.

3. A developer in accordance with claim 1 wherein said mixture contains about 50 parts of I, II, and III, and about 50 parts of IV.

4. A developer in accordance with claim 1 wherein the mixture is comprised of I, ethyl-oleyl phosphoric monoacid diester, II, oleyl phosphoric diacid monoester, and III, ethyl phosphoric diacid monoester; and wherein I is present in an amount of greater than about 80 mole percent, and II and III are present in an amount of less than about 20 mole percent.

5. A developer in accordance with claim 4 wherein I is present in an amount of from about 85 to about 95 mole percent, and II and III are present in an amount of from about 5 to about 15 mole percent, and wherein II comprises at least about 67 percent of the 5 to 15 mole percent.

6. A developer in accordance with claim 4 wherein I is present in an amount of from about 85 to about 95 mole percent, II is present in an amount of from about 3 to about 10 mole percent, and III is present in an amount of from about 2 to about 5 mole percent; or wherein I is present in an amount of from about 85 to about 95 mole percent, and II is present in an amount of from about 15 to about 5 mole percent, and wherein said mole percents total about 100.

7. A developer in accordance with claim 2 wherein IV is

IV

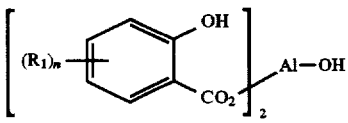

-continued

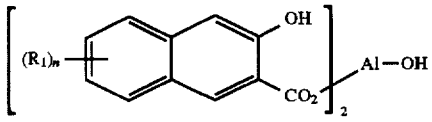

the hydrates thereof, or mixtures thereof; wherein $R_1$ is selected from the group consisting of hydrogen and methyl, and n represents a number of from about 1 to about 6.

8. A developer in accordance with claim 7 wherein IV is hydroxy bis[3,5-di-tertiary butyl salicylic] aluminate, or the hydrate thereof.

9. A developer in accordance with claim 1 wherein the colorant is a pigment and wherein IV is hydroxy bis[3,5-di-tertiary butyl salicylic] aluminate, or the hydrate thereof.

10. A developer in accordance with claim 1 wherein the colorant is a pigment, wherein IV is hydroxy bis[3,5-di-tertiary butyl salicylic] aluminate, and wherein the charge control agent is present and is a poly(ethylene oxide-b-propylene oxide-b-ethylene oxide) triblock copolymer solid, and is of the formula $(CH_2—CH_2—O)_x—(CH_2—CHCH_3—O)_y—(CH_2—CH_2—O)_x$ wherein x and y represent the number of ethylene oxide and propylene oxide repeat segments, respectively.

11. A developer in accordance with claim 10 wherein x is from about 43 to about 1,056 and y is from about 16 and to about 416, and said triblock copolymer possesses a ($M_w$) molecular weight range of from about 4,700 to about 11,7000 when the triblock copolymer has a composition of about 80 percent polyethylene oxide (PEO) and about 20 percent polypropylene oxide (PPO).

12. A developer in accordance with claim 1 wherein said liquid has a viscosity of from about 0.5 to about 20 centipoise and resistivity equal to or greater than about $5\times10^9$, and said resin has a volume average particle diameter of from about 0.1 to about 30 microns.

13. A developer in accordance with claim 1 wherein the resin is a copolymer of ethylene and vinyl acetate.

14. A developer in accordance with claim 1 wherein the colorant is present in an amount of from about 0.1 to about 60 percent by weight based on the total weight of the developer solids.

15. A developer in accordance with claim 1 wherein the colorant is present and is a pigment of carbon black, cyan, magenta, yellow or mixtures thereof, each present in an amount of from about 25 to about 60 weight percent.

16. A developer in accordance with claim 1 wherein the charge control agent is present in an amount of from about 0.05 to about 10 weight percent based on the weight of the developer solids of resin, colorant, and charge control agent.

17. A developer in accordance with claim 1 wherein the liquid for said developer is an aliphatic hydrocarbon.

18. A developer in accordance with claim 17 wherein the aliphatic hydrocarbon is a mixture of branched hydrocarbons of from about 8 to about 16 carbon atoms, or a mixture of normal hydrocarbons of from about 8 to about 16 carbon atoms.

19. A developer in accordance with claim 17 wherein the aliphatic hydrocarbon is a mixture of branched hydrocarbons of from about 8 to about 16 carbon atoms.

20. A developer in accordance with claim 1 wherein the resin is an alkylene polymer, a styrene polymer, an acrylate polymer, a polyester, or mixtures thereof.

21. An imaging method which comprises forming an electrostatic latent image followed by the development thereof with the liquid developer of claim 1, and wherein said colorant is present.

22. An ionographic imaging method which comprises charging a receptor followed by the development thereof with the developer of claim 1, and wherein said colorant is present.

23. A developer in accordance with claim 1 further containing a charge adjuvant.

24. A mixture comprised of phosphoric acid esters I, II and III, and IV a nonpolar liquid soluble organic aluminum complex, of the formulas

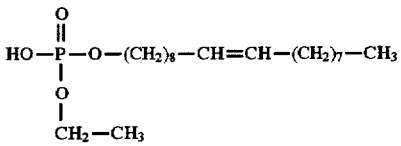

I

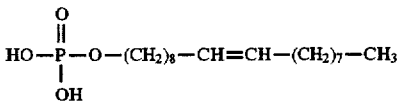

II

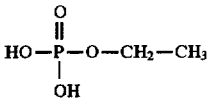

III

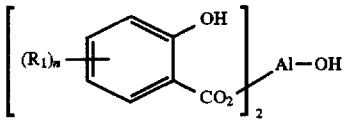

-continued

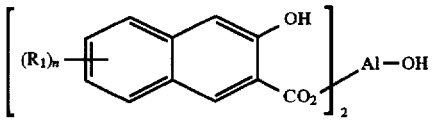

hydrates thereof, or mixtures thereof; wherein $R_1$ is selected from the group consisting of hydrogen and alkyl, and n represents a number.

25. A mixture in accordance with claim 24 wherein I is an ethyl oleyl phosphoric monoacid diester present in an amount of about greater than 80 mole percent, and the mixture further includes a nonpolar liquid and a colorant.

26. A developer in accordance with claim 2 wherein the colorant is a cyan pigment.

27. A positively charged liquid developer comprised of a nonpolar liquid, resin, colorant, and a charge director, and wherein the charge director is comprised of a mixture of Formulas I and II.

* * * * *